US011686553B2

(12) United States Patent
Foster

(10) Patent No.: US 11,686,553 B2
(45) **Date of Patent: *Jun. 27, 2023**

(54) FIREARM RETAINER FOR HOLSTERS

(71) Applicant: Turning Point Distribution, LLC, Mill Spring, NC (US)

(72) Inventor: David Foster, Mill Spring, NC (US)

(73) Assignee: Turning Point Distribution, LLC, Mill Spring, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/366,667

(22) Filed: Jul. 2, 2021

(65) Prior Publication Data

US 2022/0003520 A1 Jan. 6, 2022

Related U.S. Application Data

(63) Continuation of application No. 16/846,556, filed on Apr. 13, 2020, now Pat. No. 11,054,215.

(60) Provisional application No. 62/862,125, filed on Jun. 16, 2019.

(51) Int. Cl.
*F41C 33/02* (2006.01)
*F41C 33/04* (2006.01)

(52) U.S. Cl.
CPC ..... *F41C 33/0236* (2013.01); *F41C 33/0209* (2013.01); *F41C 33/043* (2013.01)

(58) Field of Classification Search
CPC ..... F41C 33/02; F41C 33/00; F41C 33/04; F41C 33/0263; F41C 33/0209; F41C 33/0245; A45F 2200/0591; Y10S 224/911; Y10S 224/912
USPC ..... 224/192, 193, 198, 243, 911, 912, 244
See application file for complete search history.

(56) References Cited

U.S. PATENT DOCUMENTS

| | | | |
|---|---|---|---|
| 1,635,984 | A | 7/1927 | Corriston |
| 1,750,139 | A | 3/1930 | Swift |
| 2,531,867 | A | 11/1950 | Wurdinger |
| 2,551,913 | A | 5/1951 | Toby |
| 3,866,811 | A | 2/1975 | Hamby |
| 3,910,469 | A | 10/1975 | Baldocchi |
| 4,277,007 | A | 7/1981 | Bianchi et al. |
| 4,925,075 | A | 5/1990 | Rogers |
| 4,934,574 | A | 6/1990 | Salandre |
| 5,018,654 | A | 5/1991 | Rogers et al. |
| 5,094,376 | A | 3/1992 | Baruch |

(Continued)

FOREIGN PATENT DOCUMENTS

DE 297 14 405 1/1998

OTHER PUBLICATIONS

Search Report and Written Opinion for PCT Application No. PCT/US2020/037393, dated Aug. 11, 2020, 13 pages.

*Primary Examiner* — Corey N Skurdal
(74) *Attorney, Agent, or Firm* — Weide & Miller, Ltd.

(57) ABSTRACT

A firearm retention mechanism is provided for a holster. The device comprises first and second arms that each have a first end and a second end, outwardly extending retention elements and trigger guard stops, and a fastener which connects the first and second arms so that they define an open top, with the retention elements and trigger guard stops facing one another, the trigger guard stops located below the retention elements. The arms are connected to sides of the holster with the open top facing upwardly to receive a trigger guard of the firearm, which is then pressed between the retention elements.

17 Claims, 6 Drawing Sheets

(56) References Cited

U.S. PATENT DOCUMENTS

| | | | | |
|---|---|---|---|---|
| 5,129,562 | A * | 7/1992 | Bianchi | F41C 33/0263 224/244 |
| 5,284,281 | A | 2/1994 | Nichols | |
| 5,395,021 | A | 3/1995 | Brown | |
| 5,419,474 | A | 5/1995 | Marx et al. | |
| 5,551,611 | A | 9/1996 | Gilmore | |
| 5,810,221 | A | 9/1998 | Belesky et al. | |
| 5,810,222 | A | 9/1998 | Shoemaker | |
| 5,855,305 | A | 1/1999 | Nichols | |
| 5,961,013 | A | 10/1999 | Collins | |
| 6,112,962 | A | 9/2000 | Matthews | |
| 6,230,946 | B1 | 5/2001 | Vor Keller et al. | |
| 6,276,581 | B1 | 8/2001 | Glock | |
| 6,547,111 | B2 | 4/2003 | French | |
| 6,588,635 | B2 | 7/2003 | Vor Keller et al. | |
| 6,641,009 | B2 | 11/2003 | French et al. | |
| 6,732,891 | B2 | 5/2004 | Locklear, III | |
| 6,752,300 | B2 | 6/2004 | Har-Shen | |
| 6,769,582 | B1 | 8/2004 | Beletsky et al. | |
| 6,854,626 | B2 | 2/2005 | Liao | |
| D537,246 | S | 2/2007 | Carver et al. | |
| D539,030 | S | 3/2007 | Carver et al. | |
| D543,353 | S | 5/2007 | Carver et al. | |
| D543,354 | S | 5/2007 | Carver et al. | |
| D567,501 | S | 4/2008 | Zusman | |
| D568,043 | S | 5/2008 | Zusman | |
| 7,841,497 | B1 | 11/2010 | Gregory et al. | |
| 7,950,552 | B2 | 5/2011 | Fan | |
| 8,235,263 | B1 | 8/2012 | Yeates et al. | |
| RE44,428 | E | 8/2013 | Spielberger | |
| 8,720,754 | B2 | 5/2014 | Kirsch | |
| 8,720,755 | B2 | 5/2014 | Gregory et al. | |
| 8,851,344 | B2 | 10/2014 | Baumann et al. | |
| 8,910,839 | B2 | 12/2014 | Clifton | |
| 9,086,254 | B1 | 7/2015 | Plappert | |
| 9,500,440 | B2 | 11/2016 | Gordon et al. | |
| D784,008 | S | 4/2017 | Rogers et al. | |
| 9,664,480 | B2 | 5/2017 | Faifer | |
| D801,041 | S | 10/2017 | Lance et al. | |
| 10,101,120 | B2 | 10/2018 | Gordon et al. | |
| D838,474 | S | 1/2019 | Tang | |
| 10,168,121 | B2 | 1/2019 | Gordon et al. | |
| 10,302,390 | B2 | 5/2019 | Faifer | |
| 10,655,930 | B2 | 5/2020 | Gordon et al. | |
| 2002/0017541 | A1 | 2/2002 | French | |
| 2002/0134803 | A1 | 9/2002 | Lowe et al. | |
| 2003/0141331 | A1 | 7/2003 | Liu | |
| 2005/0205624 | A1 | 9/2005 | French et al. | |
| 2007/0108242 | A1 | 5/2007 | Rassias | |
| 2009/0014484 | A1 | 1/2009 | Spielberger | |
| 2010/0011904 | A1 | 1/2010 | Flanders | |
| 2010/0176165 | A1 | 7/2010 | Lowe et al. | |
| 2011/0266317 | A1 | 11/2011 | Clifton | |
| 2012/0286005 | A1 | 11/2012 | Farnlacher et al. | |
| 2014/0291363 | A1 | 10/2014 | Clifton, Jr. | |
| 2014/0305975 | A1 | 10/2014 | Ribas | |
| 2019/0049214 | A1 | 2/2019 | Courtney | |
| 2020/0240744 | A1 | 7/2020 | Rogers et al. | |

* cited by examiner

FIREARM RETAINER FOR HOLSTERS

RELATED APPLICATION DATA

This application is a continuation of U.S. application Ser. No. 16/846,556, filed Apr. 13, 2020, which claims priority to U.S. Provisional Application Ser. No. 62/862,125, filed Jun. 16, 2019, which prior applications are incorporated by reference in their entirety herein.

FIELD OF THE INVENTION

The present invention relates to firearm holsters, and more particularly to a firearm retention mechanisms for holsters.

BACKGROUND OF THE INVENTION

Holsters are commonly used to transport firearms, such as handguns. It is desirable for the holster to securely retain the firearm so that, for example, the firearm doesn't inadvertently fall out.

In the case of holsters molded from plastic or Kydex, various retention devices may be molded into the holster in order to aid in retaining a firearm in the holster. In many cases, these devices are locking type devices where a lock body engages the firearm to lock it in place and which require a user to operate a push-button or the like in order to release the firearm from the holster.

In the case of leather holsters, a strap or cover may be provided which the user can pull over the grip end of the firearm once it is located in the holster. The user may secure the strap or cover with a buckle, snap or the like.

One problem with such existing holsters is that the retention devices may be complex and/or then not permit quick removal of the firearm when it is needed. For example, push-button retention devices generally include a movable lock and various moving parts that can move the lock between a locked position and then, when a push button or lever is activated by the user, an unlocked position. In the case of holsters with straps or covers, those straps or covers interfere with quick removal of the firearm from the holster.

A holster with a firearm retainer and a firearm retention mechanism for a holster which overcomes these and other issues is desired.

SUMMARY OF THE INVENTION

One aspect of the invention is a firearm retention device or mechanism for a holster and a method of using the same.

In one embodiment, the firearm retention mechanism may comprise a first arm and a second arm. The first and second arms each have a first end and a second end, a first side and a second side, a retention element extending outwardly from the first side and a trigger stop extending outwardly from the first side, the trigger stop spaced from the first retention element towards the second end, a first mounting aperture, a second mounting aperture and a third mounting aperture, the second mounting aperture located between the trigger stop and the second end, and a fastener passing through the second aperture of the first and second arms and a resilient member between the first and said second arms, thereby joining said arms in a position that the retention elements face one another and the first and second trigger stops are aligned with one another.

In one embodiment, the firearm retention mechanism is located in a holster, such as a pocket thereof, with the first ends of the first and second arms facing upwardly towards a top or open end of the holster for receiving a trigger guard of a firearm as the firearm is lowered into the pocket of the holster. In one embodiment, the first and second arms are connected to sides of the holster, such as with fasteners which pass through the first and third mounting apertures.

In one embodiment, the trigger stop on each arm comprises a first or long projection and a second or short projection, with the first or long projection on one arm aligned with the second or short projection on the other arm, so that the combinations of projections define a trigger guard engaging surface or platform.

In one embodiment, the first and second arms have a first closed position where the first and second retention elements are spaced apart by a first distance and the first and second trigger stops touch, and a second open position where the first and second retention elements are spaced apart by a second distance which is greater than the first distance to allow a trigger guard to pass between them.

In one embodiment, the firearm retention mechanism is particularly suited for use with a leather holster. The first and second arms may be formed of a durable and generally rigid material such as plastic.

In an embodiment of use, a user moves a firearm downwardly into a pocket of the holster; presses a trigger guard of the firearm between the retention elements on the first and second arms, whereby the trigger guard presses the retention elements away from one another by movement of the first and second arms away from one another, and then lowers the firearm downwardly past the retention elements until the trigger guard engages the trigger guard stop, whereby the firearm is retained in the holster. The firearm may be removed from the holster by raising the firearm directly upward, causing the trigger guard to pass between the first and second retention elements, disconnecting the firearm from the firearm retention mechanism.

Further objects, features, and advantages of the present invention over the prior art will become apparent from the detailed description of the drawings which follows, when considered with the attached figures.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Figure 1:
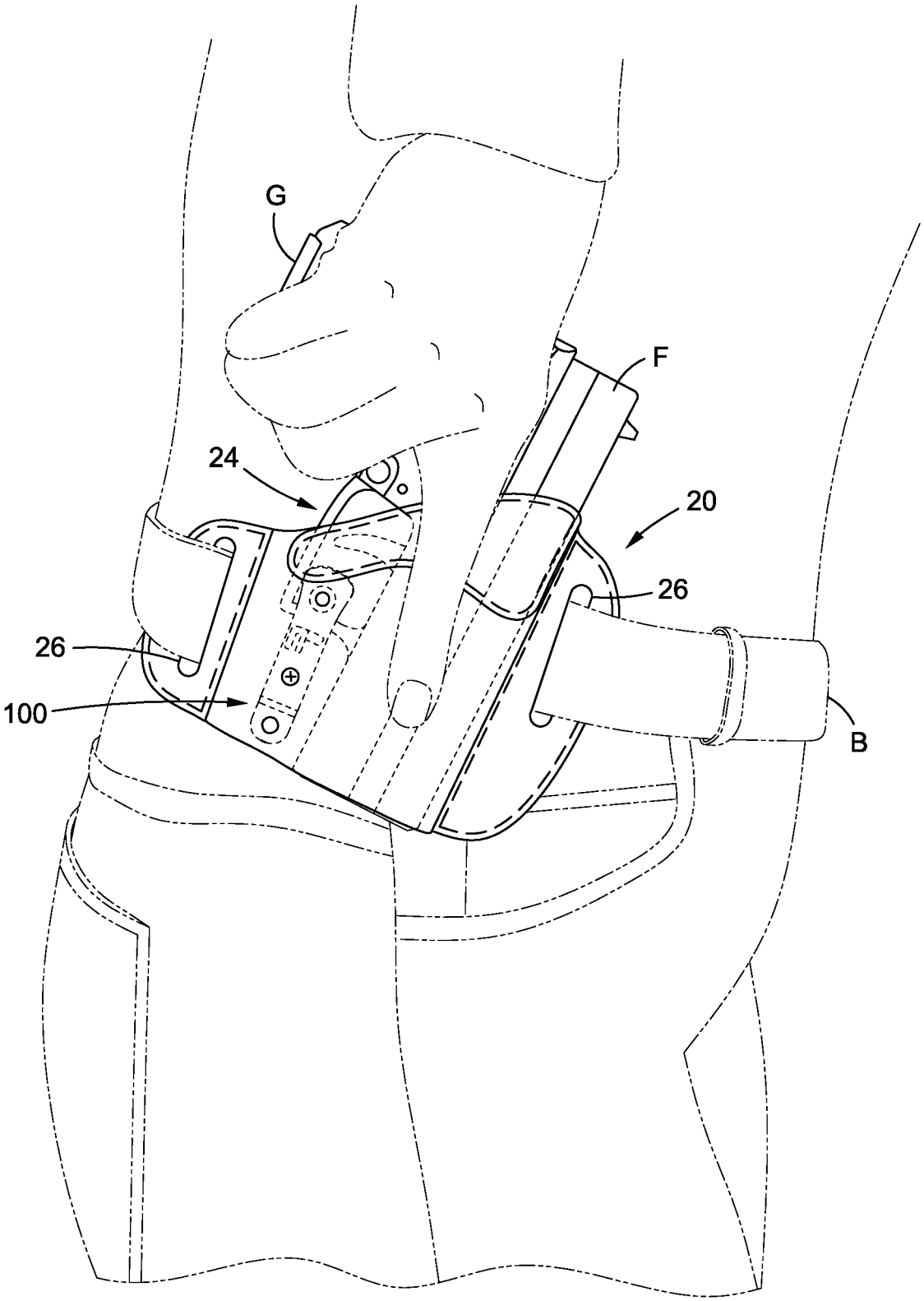
FIG. 1 illustrates a holster having a firearm retainer in accordance with one embodiment of the invention.
Figure 2:
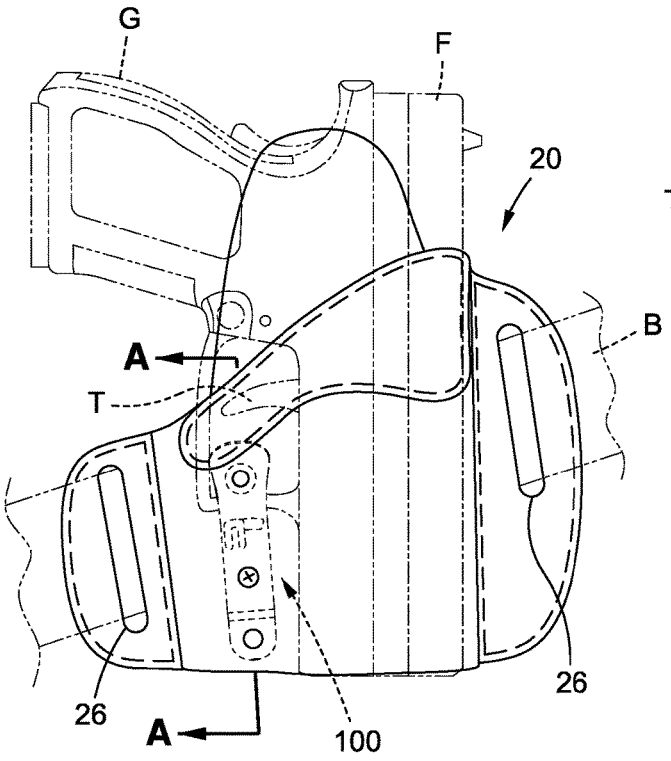
FIGS. 2 and 3 illustrate aspect of the holster illustrated in FIG. 1 and use thereof.
Figure 3:
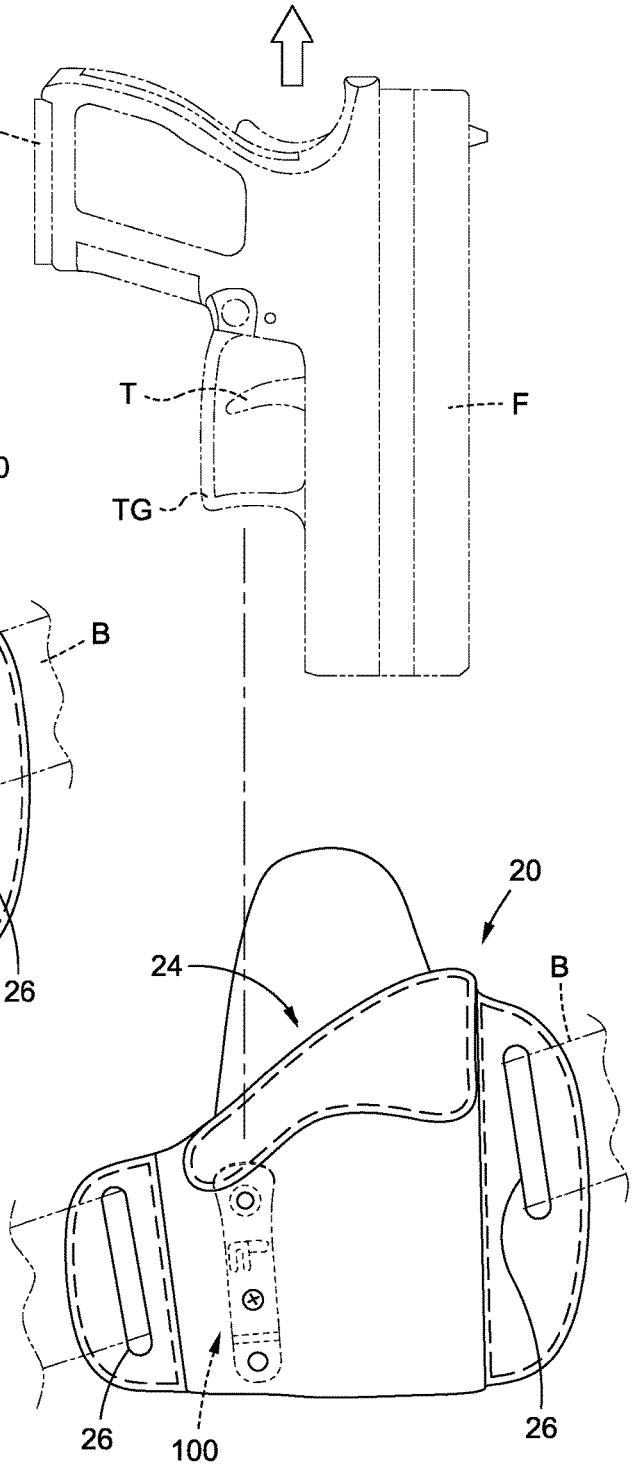

One embodiment of the invention is a firearm retention device or mechanism for a firearm holster. One embodiment of a holster 20 is illustrated in FIG. 1. The holster 20 may have various configurations. In the embodiment illustrated in FIG. 1, the holster 20 has a body which defines a pocket 24 for receiving a firearm F. The pocket 24 preferably has a generally closed bottom and sides, and an open top, thus allowing a user to insert the firearm muzzle-end down into the pocket 24, whereby the firearm F is located partially within the holster 20 and with a grip portion G generally accessible to the user (for removing the firearm). FIG. 2 illustrates a condition where the firearm F is located in the pocket 24 of the holster 20, and FIG. 3 illustrates a condition where the firearm F has been raised upwardly out of the holster 20.

In one embodiment, the pocket 24 may be formed by connecting front and back panel members to one another. The shape of the holster 20 may vary. In a preferred embodiment, the holster 20 is constructed from leather or a similar generally pliable and durable material such as a synthetic leather.

Preferably, the holster 20 is configured to be mounted to or worn by a user, either directly or to the clothing that the user is wearing. The holster 20 preferably defines or includes one or more mounts, or one or more mounting or connecting elements. The mounts might comprise, as illustrated, one or more belt openings 26 which allow the holster 20 to be connected to a belt B which is being worn by a user. Of course, other mounting or connecting elements might be utilized, such as clips, straps and the like (such as depending upon how the holster is to be mounted to or worn by the user—such as for mounting to clothing of the wearer at the waist, a shoulder strap for wearing about the shoulder of the wearer, etc.).

In one embodiment, the holster 20 further comprises a firearm retention device or mechanism 100.

Figures 4A, 4B, 4C:
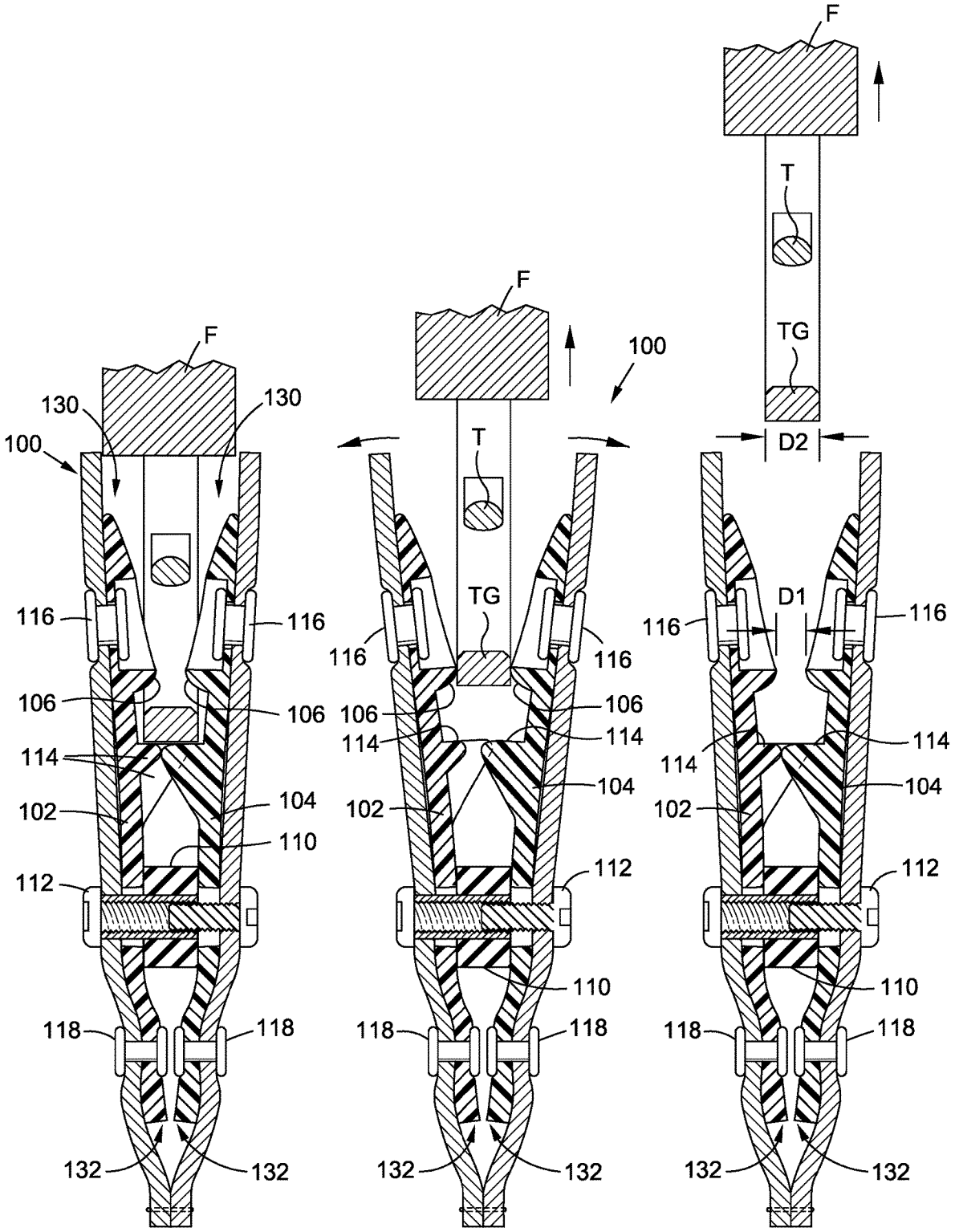
FIGS. 4A, 4B and 4C is a cross-sectional view of the firearm retainer illustrated in FIG. 2 along line A-A, in three different use positions.
Figure 5A:
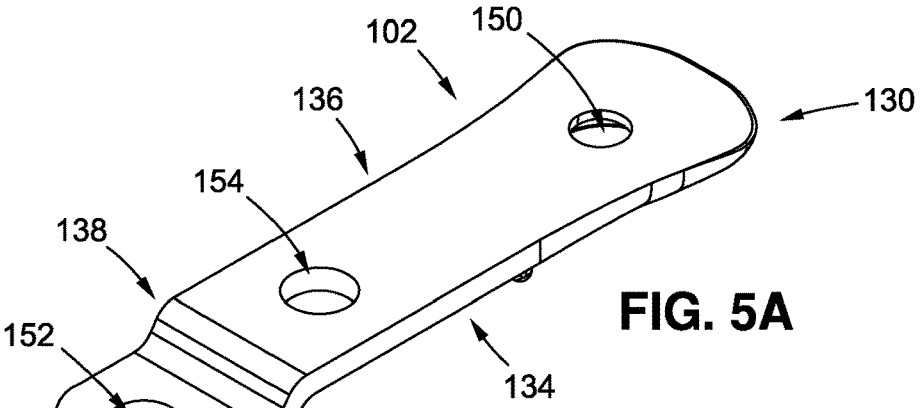
FIG. 5A is a rear perspective view of an arm of a firearm retention mechanism in accordance with the invention.
Figure 6:
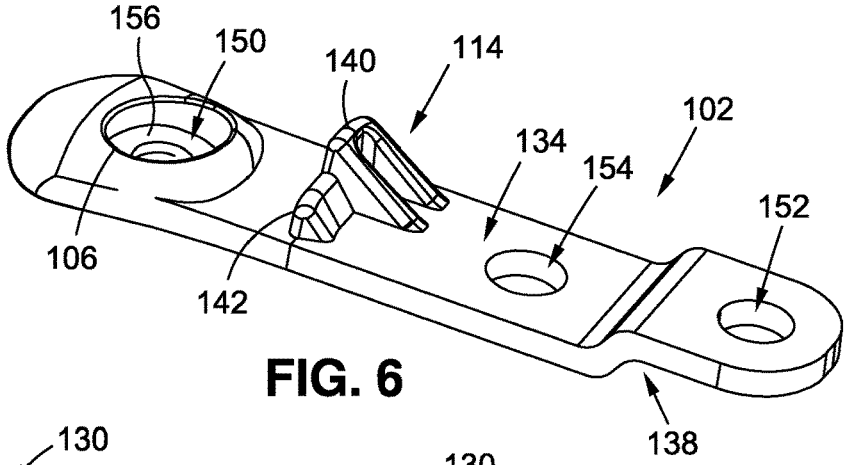
FIG. 6 is a front perspective view of the arm illustrated in FIG. 5A.
Figure 5B:
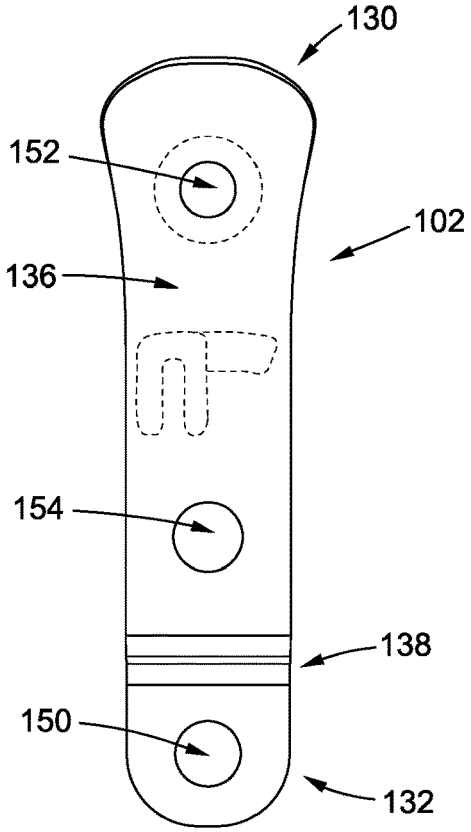
FIG. 5B is a rear elevation view of the arm illustrated in FIG. 5A.
Figure 7:
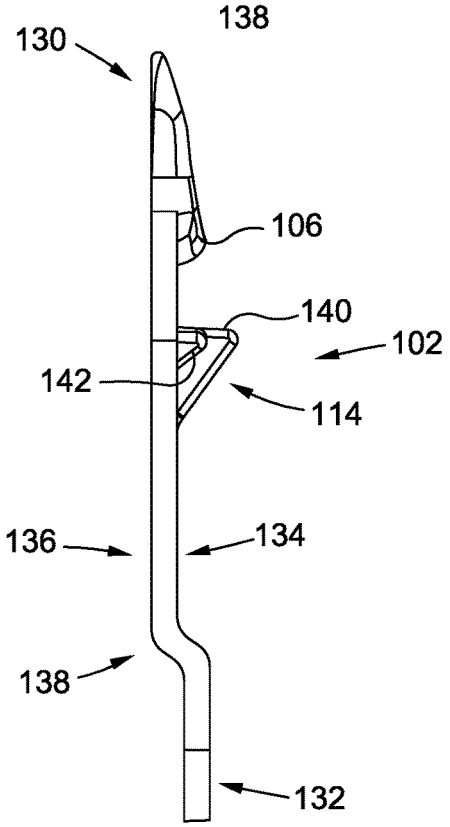
FIG. 7 is a side elevation view of the arm illustrated in FIG. 5A.

In one embodiment, referring to FIGS. 4A, 4B and 4C, the firearm retainer or firearm retention mechanism 100 comprises a first body (or arm) 102 and a second body (or arm) 104 which are connected to one another, and one or more retention elements 106. In one embodiment, the arms 102, 104 are generally identical in shape, although as described below, they might be different.

One configuration of the arms 102, 104 will be described with reference to FIGS. 5A, 5B 6 and 7, wherein one of the arms 102 is illustrated, it being understood that the other arm 104 is the same.

As illustrated, the arm 102 has a first or top end 130 and a second or bottom end 132. The arm 102 has a first or front side 134 and a second or rear side 136. The arm 102 is generally elongate, having a length from end to end which is greater than its width. Further, except for various protrusions and a step, the arm 102 may be generally planar. In the configuration illustrated, the arm 102 has a pair of generally parallel edges, and a generally rounded top and bottom end 130, 132.

In one embodiment, the arm 102 defines a step 138 between its ends, such as close to the bottom end 132, which step 138 causes a portion of the arm 102 at the bottom end 132 to protrude or extend forwardly relative to the top portion of the arm 102.

The retention element 106 preferably comprises a protrusion or extension at the front side 134 of the arm 102. As illustrated, the retention element 106 comprises raised area of the arm 102—e.g. an area which is raised or extends outwardly beyond one or more of the portions of the arm 102 adjacent thereto.

The arm 102 preferably also defines a stop 114. In one embodiment, the stop 114 also comprises a protrusion or extension at the front side 134 of the arm 102. As described below, in one embodiment, the retention element 106 is located near the top end 130 of the arm 102 and the stop 114 is spaced from the retention element 106 and is located closer to the bottom end 132 of the arm 102.

The stop 114 might have a number of configurations. In a preferred configuration, the stop 114 has a first extension 140 and a second extension 142. The first and second extensions 140,142 may be located generally side-by-side across a width of the front 134 of the arm 102. In the embodiment illustrated, they are connected, but they might be spaced apart.

The first extension 140 preferably extends or protrudes outwardly farther than the second extension 142. As illustrated in FIGS. 4A-4C, when the first and second arms 102, 104 face one another, the first extension 140 on the first arm 102 is aligned with the second extension 142 on the second arm 104, and the second extension 142 on the first arm 102 is aligned with the first extension 140 on the second arm 104, whereby the pairs of aligned extensions cooperate, as described in more detail below. In one embodiment, the first extension 140 extends more than 50% of the distance between the two arms 102, 104.

Each extension 140,142 may define a generally planar surface which extends generally perpendicular to the arm 102 and faces upwardly towards the top end 130. In the embodiment illustrated, the extensions 140,142 may include one or more strengthening ribs, struts or the like, to prevent them from bending or flexing downwardly towards the bottom end 132 when a load or force is applied to the faces thereof.

In one embodiment, the arms 102, 104 are configured to be connected to one another, as well as to the holster 20. As illustrated, the arm 102 may thus include one or more apertures or mounting holes for various fasteners.

A first aperture 150, a second aperture 152 and a third aperture 154 may be provided through the arm 102 from the front side to the rear side. The apertures 150, 152, 154 may be generally circular in shape. In one embodiment, the first aperture 150 is located in the retention element 106. As illustrated, this aperture 150 may include a seat 156. The seat 156 is preferably recessed from a top of the retention element 106, for reasons described below.

The second aperture 152 is located near the bottom end 132 of the arm 102. The third aperture 154 is located between the step 138 and the stop 114.

In a preferred embodiment, the first and second arms 102, 104 are made of plastic or a similar hard and durable material. The arms 102, 104 might, for example, be formed in a molding process.

As indicated, the firearm retention mechanism 100 comprises the first arm 102 and the second arm 104. As illustrated in FIGS. 4A-4C, the first and second arms 102, 104 are connected or joined, preferably between their first and second ends 130, 132. While they could be joined together permanently, such as by forming them as a common arm, in a preferred embodiment they are removably and, moreover, adjustably connected to one another. First, the arms 102, 104 are preferably removably connectable—e.g. are separate elements which are then connected to one another in a manner which permits them to be disconnected. Second, the arms 102, 104 are preferably adjustably connected—e.g. the connection between them is adjustable to, as described below, adjust or control generated biasing force.

As illustrated, the first and second arms 102, 104 may be joined with one or more fasteners 112, such as corresponding male and female threaded connectors. Of course, other fasteners such as bolt, screw, rivet, etc., might be utilized. Further, a flexible or resilient member 110, such as a rubber washer, is located between the first and second arms 102, 104. In one embodiment, the fastener 112 passes through the resilient member 110. A user may tighten or loosen the fastener 112, thus applying pressure on the resilient member 110, thus causing the first and second arms 102, 104 to be more or less tightly pressed together. As detailed below, this generates a biasing force that biases the arms 102, 104 towards one another.

In one embodiment, once the arms 102, 104 are connected, the firearm retaining device 20 generally has an open end at the top (corresponding to the top ends 130 of the arms) and a closed bottom end (corresponding to the bottom ends 132 of the arms).

The firearm retention mechanism 100 is preferably located inside of the pocket 24 of the holster 20. As better illustrated in FIGS. 4A-4C, the firearm retention mechanism 100 is preferably oriented so that the first ends 130 of the first and second arms 102, 104 face upwardly towards the open top end of the pocket 24. In other words, the firearm retention mechanism 100 is oriented in the holster 20 so that its open end faces upwardly, extend towards the open top of the holster, so that is configured to receive the firearm F as it is lowered into the holster 20.

In a one embodiment, the firearm retention mechanism 100 is connected to the holster 20. In a preferred embodiment, each arm 102, 104 is connected to the holster 20. As illustrated, a first fastener, such as a rivet 116 is used to connect the first arm 102 to the holster 20, such as to one side of the holster. This rivet 116 may pass through the first aperture 150 and through or into engagement with the holster 20, with a head of the rivet 116 positioned against the seat 156 and recessed below the top of the retention element 116. Likewise, a similar fastener, such as a rivet 116, may be used relative to the second arm 104 to connect it to the holster 20, such as the opposite side of the holster. In addition, a second fastener, such as a rivet 118, may pass through the second aperture 152 of the first arm 102, and through or into engagement with the holster 20, such as the first side thereof. Likewise, a similar fastener, such as a rivet 118, may be used relative to the second arm 104 to connect it to the holster 20, such as the second side thereof.

Additional details of the firearm retention mechanism 100 will be appreciated from a description of the use thereof.

Referring to FIGS. 4A-4C, in use, a user inserts the firearm F, muzzle-end down, into the pocket 24 of the holster 20. The firearm retention mechanism 100 is located and oriented to receive a trigger guard TG (best seen in FIG. 3) of the firearm F.

In particular, FIGS. 3 and 4C illustrate the firearm F when it is disassociated from the holster 20. The user may insert the firearm F into the holster 20 by lowering or pressing it downwardly into the pocket 24. As illustrated in FIG. 4C, when the firearm F is not associated with the holster 20, the firearm retention mechanism 100 is in "closed" position where the first and second arms 102, 104 are biased towards one another. In this position, a distance D1 between the retention elements 106 on each of the arms 102, 104 is less than a distance D2 which comprises the width of the trigger guard TG of the firearm F (if the distance D1 is greater than D2, the user may tighten the fastener 112 in order to bias the arms 102, 104 more tightly towards one another to reduce distance D1).

As illustrated in FIG. 2, the firearm retention mechanism 100 is positioned so that when the firearm F is positioned into the holster 20, it aligns with and accepts the trigger guard TG of the firearm F (thus, the positioning of the firearm retention mechanism 100 inside the holster 20 is important).

As illustrated in FIG. 4B, as the firearm F is inserted into the holster, the trigger guard TG is guided between the first and second arms 102, 104 at their first ends 130. Because the distance D2 is greater than D1, the trigger guard TG hits the retention elements 106 on the arms 102, 104. When sufficient force is applied to the arms 102, 104, the arms 102, 104 are forced apart, thus increasing the distance between the arms 102, 104 at the location of the retention elements 106 (such as by outward deflecting of the arms 102, 104 due to bending), thus allowing the trigger guard TG to pass between the retention elements 106 and downwardly towards the second ends 132 of the first and second arms 102, 104. Essentially, the arms 102, 104 can be moved to an "open" position in which they are slightly spread apart by the trigger guard TG to allow it to move past the one or more retention elements 106 and into a space between the arms 102, 104.

At this time the firearm F is effectively retained in the holster 20. In particular, as illustrated in FIG. 4A, once the trigger guard TG moves past the retention devices 106 of the arms 102, 104, the arms 102, 104 move back towards one another to the "closed" position where the distance between the retention elements 106 is the distance D1, which is less than the width of the trigger guard TG (it being noted that the distance between the arms 102, 104 below the retention elements 106, when the arms 102, 104 are in their closed position is greater than the width of the trigger guard D2).

As noted above, in a preferred embodiment, the firearm retention mechanism 100 includes a stop 114. The stop 114 limits downward movement of the firearm F into the firearm retention mechanism 100. The stop 114 thus serves to prevent the user from attempting to press the firearm F too far into the firearm retention mechanism 100 and, moreover, serves to position the firearm in a desired position in the firearm retention mechanism 100 and thus the holster 20 in which it sits.

In particular, as illustrated in FIG. 4A, once the trigger guard TG clears the retention elements 106, continued downward movement of the firearm F will cause the trigger guard TG to hit the top surface of the stop 114, thus limiting further downward movement. At this time, the firearm F is properly positioned in the holster 20 and is secured therein, as illustrated in FIG. 2.

Referring to FIGS. 4B and 4C, if the user desires to remove the firearm F from the holster 20, the user must apply sufficient upward force so that the trigger guard TG clears the retention elements 106 (wherein the trigger guard TG causes the first and second arms 102, 104 to move away from one another a sufficient distance at the location of the retention elements 106 to allow the trigger guard TG to pass out of the arms 102, 104).

The firearm retention mechanism 100 may have various configurations other than as specifically described and illustrated.

In one embodiment, the retention elements 106 which are associated with the first and second arms 102, 104 do not touch. In other embodiments, they might touch or the distance between them might vary. It is possible that the firearm retention mechanism might only include one retention element.

In one embodiment, means are provided for biasing the arms 102, 104 towards one another and, in a most preferred embodiment, in an adjustable manner. As described above, such a means may comprise a resilient element positioned between the arms 102, 104 and an adjusting device, such as a threaded fastener, that can be used to create a force that biases the arms towards one another. However, other means might be provided for biasing the arms 102, 104 towards one another, such as a spring or the like which pulls the two arms (or at least the first ends) towards one another.

In general, it is desired that the first ends of the arms 102, 104 be biased towards one another so that once a trigger guard TG passes the one or more retention elements 106 and separates them, the arms 102, 104 move back towards one another at their first ends. This moves the one or more retention elements 106 back inwardly to reduce a space through which the trigger guard TG may pass, creating an "interference" which must be overcome by applying a sufficiently large upward force to again cause the first and second arms 102, 104 to separate and allow the trigger guard TG to pass upwardly out of engagement with the retention mechanism.

As indicated, the firearm retention mechanism 100 may include a stop 114. In other embodiments, however, it may not include a separate stop 114. Instead, the size and/or location of the fastener 112 and/or associate resilient member 110 may be selected so that they not only connected the first and second arms 102, 104, but serve as the stop (e.g. limit the extent to which the firearm F may be pressed downwardly).

In one embodiment, the firearm retention mechanism 100 might include a trigger cover. Such a trigger cover might comprise, for example, an enlarged portion or area of one or both arms 102, 104 at the first ends 130 thereof, or an element mounted thereto. The trigger cover is preferably be configured to extend over the trigger T of the firearm F (or at least over an area between the front of the trigger T and the trigger guard TG) when the firearm is located in the holster 20 and in engagement the firearm retention mechanism 100, in order to prevent a user from engaging the trigger T accidentally.

Figure 8:
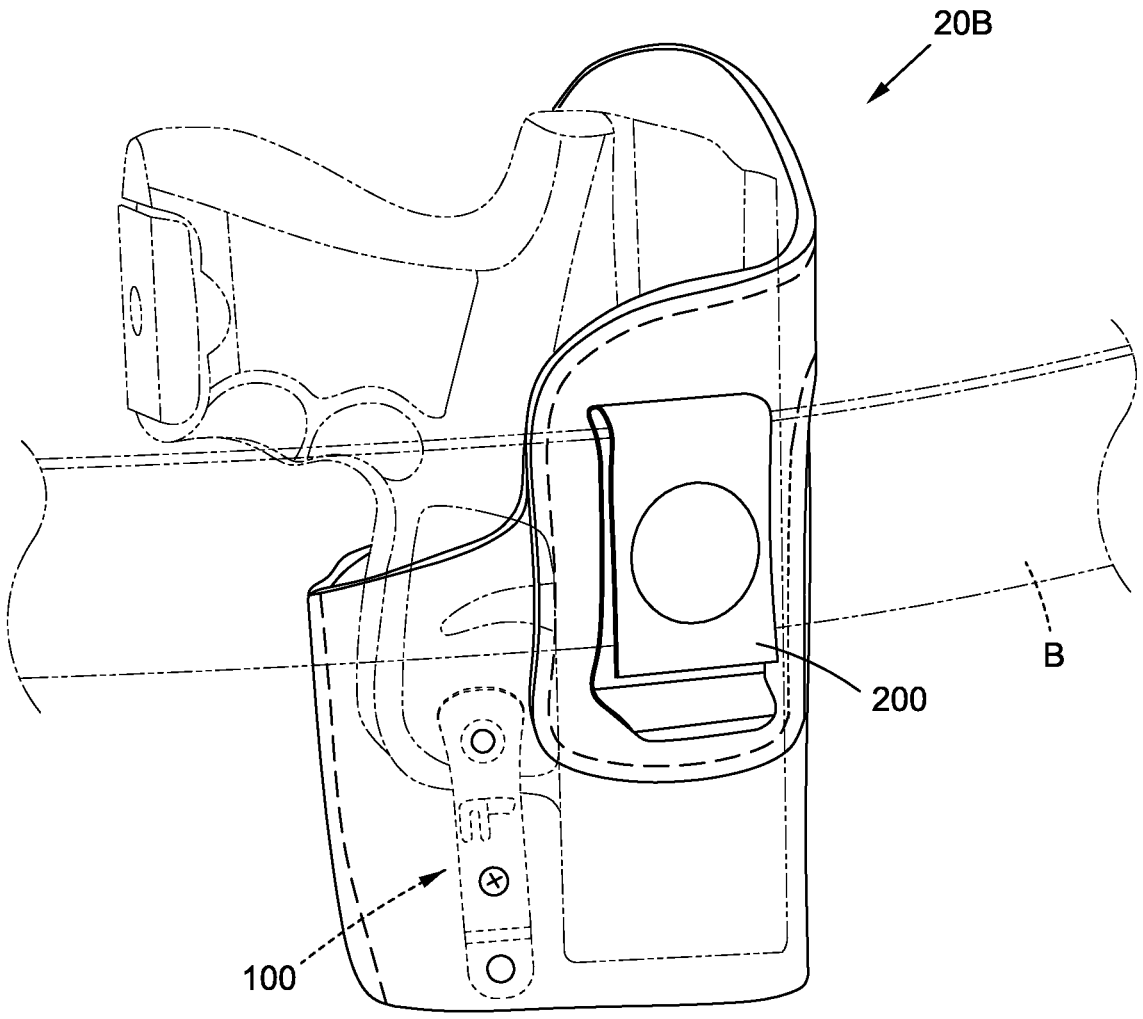
FIG. 8 illustrates a holster having a firearm retainer in accordance with another embodiment of the invention.

As indicated the firearm retention mechanism of the invention may be used with various configurations of holsters. For example, FIG. 8 illustrates another embodiment of a holster 20B that is mountable/wearable via use of one or more clips 200 (such as for attachment to a belt B of the wearer). This holster 20B still includes the firearm retention mechanism 100 of the invention.

Figure 9A:
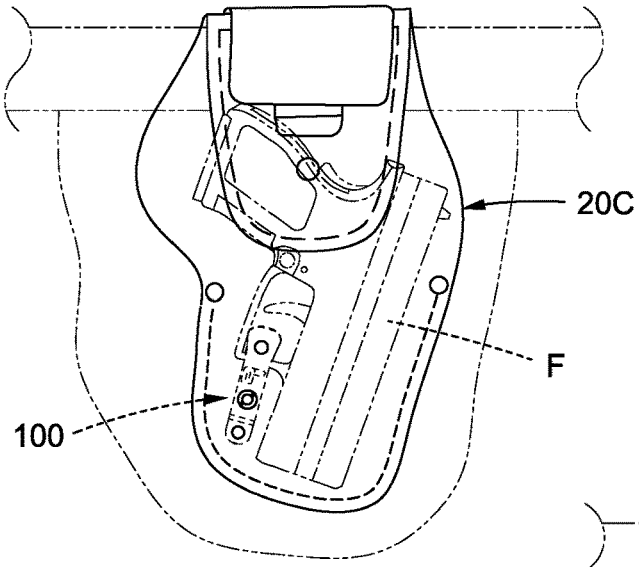
FIGS. 9A, 9B and 9C illustrate different use conditions of a holster having a firearm retainer in accordance with yet another embodiment of the invention.
Figure 9B:
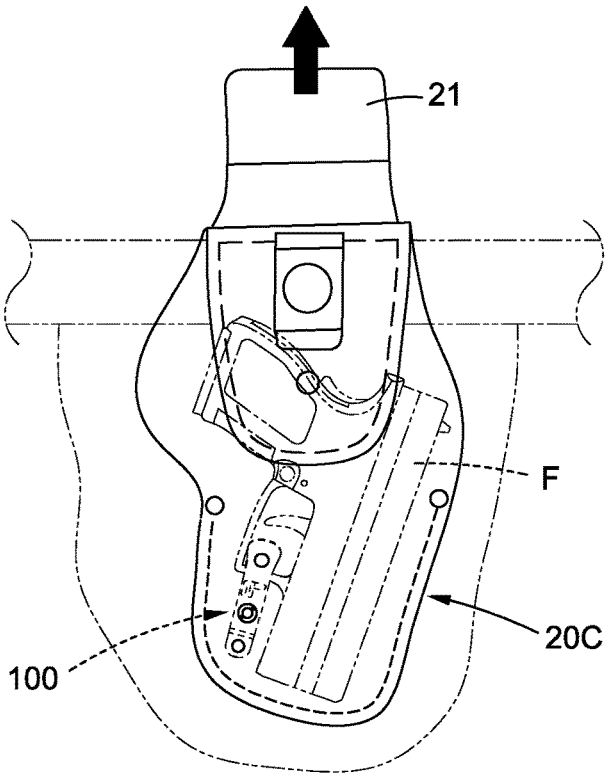
Figure 9C:
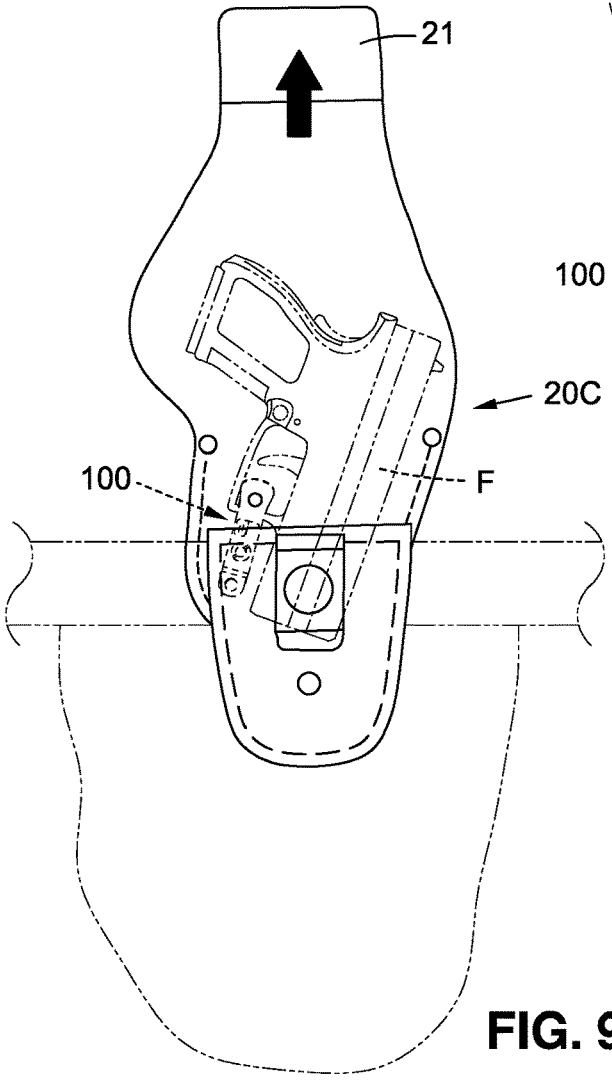

FIGS. 9A-9B illustrate use of the firearm retention mechanism of the invention with an "inside the waistband" quick-access holster 20C. This holster 20C may be configured similar to that described in U.S. Pat. No. 9,500,040 which is owned by the Applicant herein and which is incorporated by reference. As illustrated, such a holster 20C may again include a firearm retention mechanism 100 of the invention. As illustrated in FIG. 9A, when the firearm F is located in the holster 20C, it is both inside the holster 20C and inside the waistband of the wearer, but also secured by the firearm retention mechanism 100. As illustrated in FIG. 9B, to remove the firearm F, the user may pull up on a flap 21 of the holster 20C, thus raising the firearm F upwardly to the position illustrated in FIG. 9C, wherein the firearm F may be disengaged from the holster 20C and the firearm retention mechanism 100.

The firearm retention mechanism 100 has a number of advantages. First, the firearm retention mechanism may be used with any holster, including holsters which are made of leather or similar materials. Second, an advantage of the invention is that the firearm retention mechanism is automatically activated or engaged when the firearm is normally placed into and pulled out of the holster. This is unlike many retention devices where the user has to separately engage the retention device, such as by pressing a button or sliding a mechanism into or out of engagement with the firearm separately from simply inserting or removing the firearm from the holster, and it unlike many retention devices that require the user to move the firearm to some unique position or orientation in order to engage or disengage the retention mechanism, which movement is different than the normal movement for inserting and removing the firearm from the holster. Thus, the firearm retention mechanism does not slow down or interfere with quick insertion of the firearm into the holster or removal therefrom.

One particular advantage of the invention is the ability for the user to adjust the distance between the arms, including the retention elements, thus also adjusting the retention force that must be overcome to insert or remove the firearm. Some retention devices define a unitary body with a pair of fingers that can engage a firearm. Once the fingers wear or become more flexible through use, or if the user desires to associated a firearm with a narrow trigger guard, such devices become ineffective at retaining the firearm and this ineffectiveness can't be remedied.

Another particular advantage of the invention is a configuration where the arms are connected to the holster, preferably at both the top and the bottom. Because the arms are configured to deflect each time the firearm is placed into and taken out of engagement with the firearm retaining device, a risk exists that one or both of the arms may break. If that occurred, the portion of the broken arm could move to a position where it interfered with removal of the firearm or might even engage the trigger. In accordance with present invention, attachment of the arms to the holster at the top and bottom ends of the arms prevents the arms from moving out of position even if they break along their length, addressing these potential issues.

Another advantage to the invention is the preferred embodiment of the trigger guard stop. Some devices might include stops which have mating first and second members which extend towards one another. If the two members do not touch, downward pressure by a narrow trigger guard could allow the trigger guard to push through the space between the members. In accordance with the present invention, the first extension extends more than half way across the distance between the arms, thus ensuring that any trigger guard will contact the supporting surface of thereof, and the extensions are preferably configured as steps or have supporting ribs or are otherwise sufficiently rigid to prevent their downward deflection.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A method of associating and disassociating a firearm with a holster having a firearm retention mechanism comprising:

moving a firearm downwardly into a pocket of said holster;

pressing a trigger guard of said firearm between a first retention element on a first arm of said firearm retention mechanism and a second retention element on a second arm of said firearm device, whereby said trigger guard presses said first and second retention elements away from one another by movement of said first and second arms away from one another, wherein said first retention element is provided with a first aperture for receiving a first coupling member therethrough in order to couple said first arm at said first retention element to said holster, and wherein said second retention element is provided with a second aperture for receiving a second coupling member therethrough in order to couple said second arm at said second retention element to said holster;

lowering said firearm downwardly past said first and second retention elements;

biasing said first and second arms back towards one another to cause at least one first projection on said first arm and at least one second projection on said second arm to move towards one another and form a stop which limits further downward movement of said trigger guard, and thus said firearm into said pocket of said holster; and raising said firearm upwardly, causing said trigger guard of said firearm to pass between said first and second retention elements, disconnecting said firearm from said firearm retention mechanism.

2. The method in accordance with claim 1 wherein said firearm retention mechanism has a first open end and a second closed end, therein said first open end faces upwardly towards a top of said holster and receives said trigger guard as said firearm is located into said holster.

3. The method in accordance with claim 1 wherein said first and second arms are connected by a fastener and further comprising the step of adjusting a position of said fastener, thereby changing a force applied by said fastener which biases said first and second arms towards one another.

4. The method in accordance with claim 1, wherein said first aperture includes a first top and a first seat recessed from said first top, wherein said second aperture includes a second top and a second seat recessed from said second top, wherein a portion of said first coupling member is positioned against said first seat and is recessed below said first top, and wherein a portion of said second coupling member is positioned against said second seat and is recessed below said second top.

5. The method in accordance with claim 4, wherein said first coupling member is a first rivet, and wherein said second coupling member is a second rivet.

6. A firearm retention mechanism for a holster comprising:

a first arm having a first end and a second end, a first side and a second side, a first retention element extending outwardly from said first side and having a recess therein, a first trigger stop extending outwardly from said first side, said first trigger stop spaced from said first retention element towards said second end, a first mounting aperture extending from said recess in said first retention element and through said first arm, said first mounting aperture configured to receive a first fastener for connecting said first arm to said holster, and a second mounting aperture located between said first trigger stop and said second end;

a second arm having a first end and a second end, a first side and a second side, a second retention element extending outwardly from said first side and having a recess therein, a second trigger stop extending outwardly from said first side, said second trigger stop spaced from said first retention element towards said second end, a first mounting aperture extending from said recess in said second retention element and through said second arm, said second mounting aperture configured to receive a second fastener for connecting said second arm to said holster, and a second mounting aperture located between said first trigger stop and said second end; and a third fastener passing through said second aperture of said first arm and said second aperture of said second arm and passing through a resilient member between said first arm and said second arm;

whereby said first arm is connected to said holster by said first connector, said second arm is connected to said holster by said second connector, and said first and second arms are joined with said first retention element and said second retention element facing one another and with said first and second trigger stops aligned with one another.

7. The firearm retention mechanism in accordance with claim 6 wherein said resilient member comprises a rubber grommet.

8. The firearm retention mechanism in accordance with claim 6 wherein said first and second arms are made of plastic.

9. The firearm retention mechanism in accordance with claim 6 wherein said first trigger stop comprises a first projection and a second projection, said first projection extending outwardly farther than said second projection, and said second trigger stop comprises a third projection and a fourth projection, said third projection extending outwardly farther than said fourth projection, said first and fourth projections and said second and third projections aligned with one another.

10. The firearm retention mechanism in accordance with claim 9, wherein said first projection is spaced from said second projection, and wherein said third projection is spaced from said fourth projection.

11. The firearm retention mechanism in accordance with claim 9, wherein said first projection is configured to contact said fourth projection, and wherein said second projection is configured to contact said fourth projection.

12. The firearm retention mechanism in accordance with claim 9, wherein said first, second, third, and fourth projections define a generally planar surface configured to extend perpendicular to said first and second arms.

13. The firearm retention mechanism in accordance with claim 6 wherein said first and second arms have a first closed position where said first and second retention elements are spaced apart by a first distance and said first and second trigger stops touch, and a second open position where said first and second retention elements are spaced apart by a second distance which is greater than said first distance to allow a trigger guard to pass between them.

14. The firearm retention mechanism in accordance with claim 6, wherein said third fastener is adjustable.

15. The firearm retention mechanism in accordance with claim 6, wherein said first and second fasteners comprise rivets.

16. The firearm retention mechanism in accordance with claim 6, wherein said first arm is configured to be connected to a first side of said holster with said first fastener and said second arm is configured to be connected to said second side of said holster with said second fastener.

17. The firearm retention mechanism in accordance with claim 6 wherein said first retention element is generally circular in shape and extends outwardly from said first arm and second retention element is generally circular in shape and extends outwardly from said second arm.

* * * * *